US005229742A

United States Patent [19]

Miyamoto et al.

[11] Patent Number: 5,229,742

[45] Date of Patent: Jul. 20, 1993

[54] JOYSTICK

[75] Inventors: Tsutomu Miyamoto; Chikara Saitoh, both of Tokyo, Japan

[73] Assignee: Kyocera Corporation, Kyoto, Japan

[21] Appl. No.: 716,078

[22] Filed: Jun. 17, 1991

[30] Foreign Application Priority Data

Jun. 18, 1990 [JP] Japan ..... 2-64357

[51] Int. Cl.[5] ..... H01C 10/16; H01C 10/04

[52] U.S. Cl. ..... 338/128; 338/89

[58] Field of Search ..... 338/128, 89, 90, 91; 74/471, 335; 200/6 A, 6 R, 8 R, 16 R, 16 C, 16 B

[56] References Cited

U.S. PATENT DOCUMENTS

| | | | |
|---|---|---|---|
| 4,500,867 | 2/1985 | Ishitobi et al. | 338/128 |
| 4,587,510 | 5/1986 | Kim | 338/128 |
| 4,590,339 | 5/1986 | Scott-Jackson et al. | 200/6 A |
| 4,590,454 | 5/1986 | Zettergren | 338/128 |
| 4,733,214 | 3/1988 | Andresen | 338/128 |
| 4,763,100 | 8/1988 | Wood | 338/128 |
| 4,795,952 | 1/1989 | Brandstetter | 318/560 |
| 4,812,802 | 3/1989 | Nishiumi et al. | 338/128 |
| 4,825,157 | 4/1989 | Mikan | 324/208 |
| 4,849,583 | 7/1989 | Meyer | 200/6 A |
| 4,857,881 | 8/1989 | Hayes | 338/128 |
| 4,912,997 | 4/1990 | Malcolm et al. | 74/335 |
| 5,050,449 | 9/1991 | Falcou et al. | 74/471 XY |

*Primary Examiner*—Marvin M. Lateef

*Attorney, Agent, or Firm*—Spensley Horn Jubas & Lubitz

[57] ABSTRACT

A control stick is supported in an outer case such that it can be swung in two orthogonal directions. A moving member is fitted to the lower portion of the control stick through a coil spring. The lower end of the moving member is urged by the coil spring to a rotation-symmetrical cup-shaped inside surface of a guide case so as to make pressure contact with the inside surface. The curvature of the inside surface is determined so as to provide such a relationship that a contraction length of the coil spring is proportional to a square root of a tilt angle of the control stick from its neutral position.

5 Claims, 2 Drawing Sheets

JOYSTICK

BACKGROUND OF THE INVENTION

The present invention relates to what is called a "joystick".

One of conventional joysticks is of what is called a "torsion spring type" in which a torsion spring is engaged with a rotary shaft of each of a pair of variable resistors so as to automatically return a control stick to its central neutral position, as described in Japanese Utility Model Application Unexamined Publication No. Sho. 55-17379. However, in such a joystick, since a force for holding the control stick is determined by the resilient forces of the torsion springs, the holding force varies depending on the tilt angle and direction of the control stick as shown in FIG. 3. In FIG. 3, the symbols accompanying the coordinates, $\theta_1$, $\theta_2$ and F, represent the tilt angles in the X and Y directions and the stick-holding force, respectively. The variation of the holding force greatly deteriorates the ease of manipulating the control stick. Further, the holding force, which is a force for returning the control stick back to the central position, becomes smaller, as the tilt angle decreases. This in turn reduces the accuracy in returning the control stick to the central position.

To solve the above problems, the present applicant developed a joystick of a "coil spring type" in which a control stick is fitted with a single coil spring at its lower portion so that it can be elongated and compressed, and the lower end part of the control stick assembly slides, in pressure contact, on the inside surface of a guide case having a generally V-shaped cross-section, as disclosed in Japanese Utility Model Application Unexamined Publication No. Sho. 63-188906.

In the joystick of this type, the control stick is automatically returned to its central position by the resilient force of the coil spring fitted to the control stick in its lower portion. Since the control stick holding force is determined by the single coil spring, the holding force becomes uniform for any tilt direction of the control stick in a concentric circle on the inside surface of the guide case. However, even in the joystick of this type, which is simply equipped with the guide case having the cup-shaped inside surface, the holding force still changes depending on the tilt angle of the stick, resulting in a subtle variation in the manipulation feeling of the stick.

SUMMARY OF THE INVENTION

Accordingly, an object of the present invention is to provide a coil spring type joystick in which a control stick holding force is uniform for any tilt direction and angle of the control stick, to improve its ease of manipulation and precision in returning the stick to the central position.

According to the present invention, a joystick comprises:

a control stick supported in an outer case such that the control stick can be swung in two orthogonal directions;

a coil spring;

a moving member coaxially fitted to a lower portion of the control stick through the coil spring; and a guide member having a rotation-symmetrical cup-shaped inside surface to which a lower end of the moving member is urged by the coil spring so as to make pressure contact with the inside surface, the inside surface having a curvature which provides such a relationship that a contraction length of the coil spring is proportional to a square root of a tilt angle of the control stick from its neutral position.

With the above construction, a holding force for the control stick is made uniform for any tilt angle of the control stick, as well as for any tilt direction.

BRIEF DESCRIPTION OF THE DRAWINGS

FIG. 1(*b*) is a vertical sectional view of the joystick according to the embodiment, in which the control stick is tilted by an angle $\theta$;

FIG. 1(*c*) is a perspective view of the joystick of FIG. 1(*a*);

DESCRIPTION OF THE PREFERRED EMBODIMENT

An embodiment of the present invention will be described hereinafter with reference to FIGS. 1(*a*)–1(*c*) and 2.

Figure 1A:
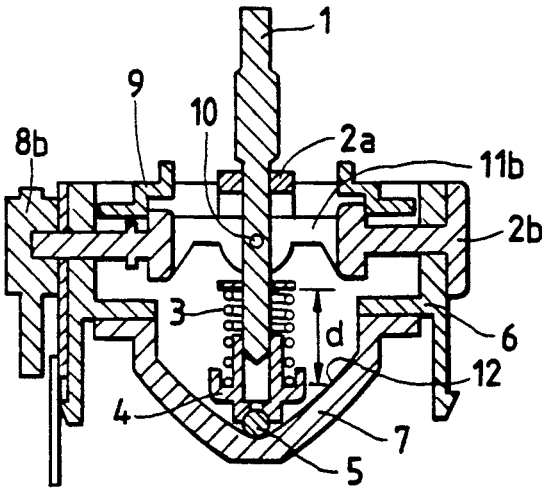
FIG. 1(*a*) is a vertical sectional view showing a joystick according to an embodiment of the invention, in which a control stick is in its neutral position.
Figure 1B:
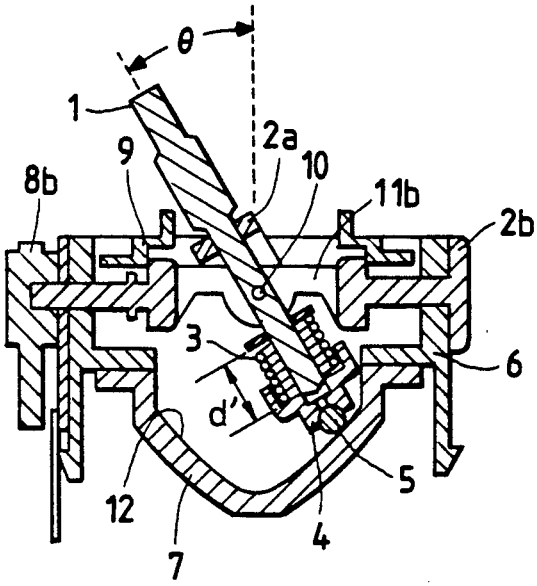
Figure 1C:
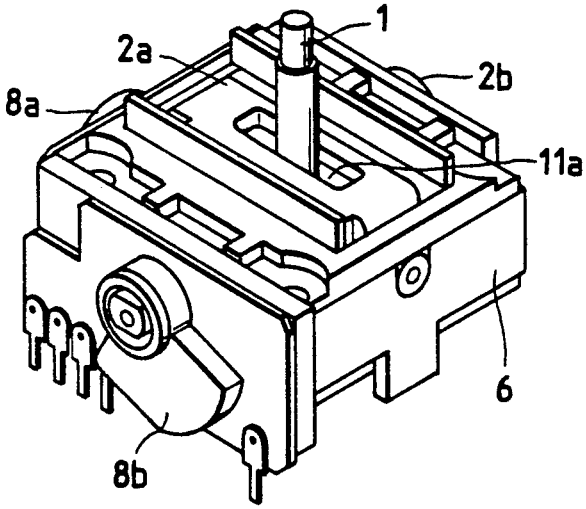
Figure 2:
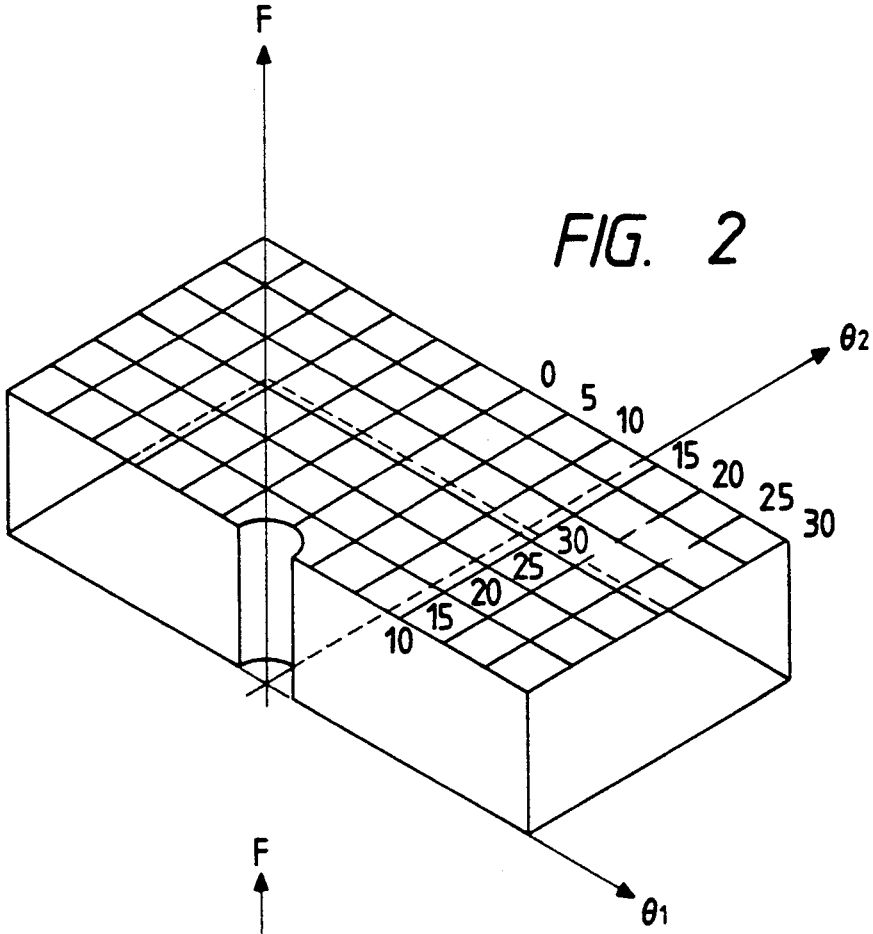
FIG. 2 is a graph showing the magnitude of a control stick holding force in the joystick of FIGS. 1(*a*)–1(*c*)
Figure 3:
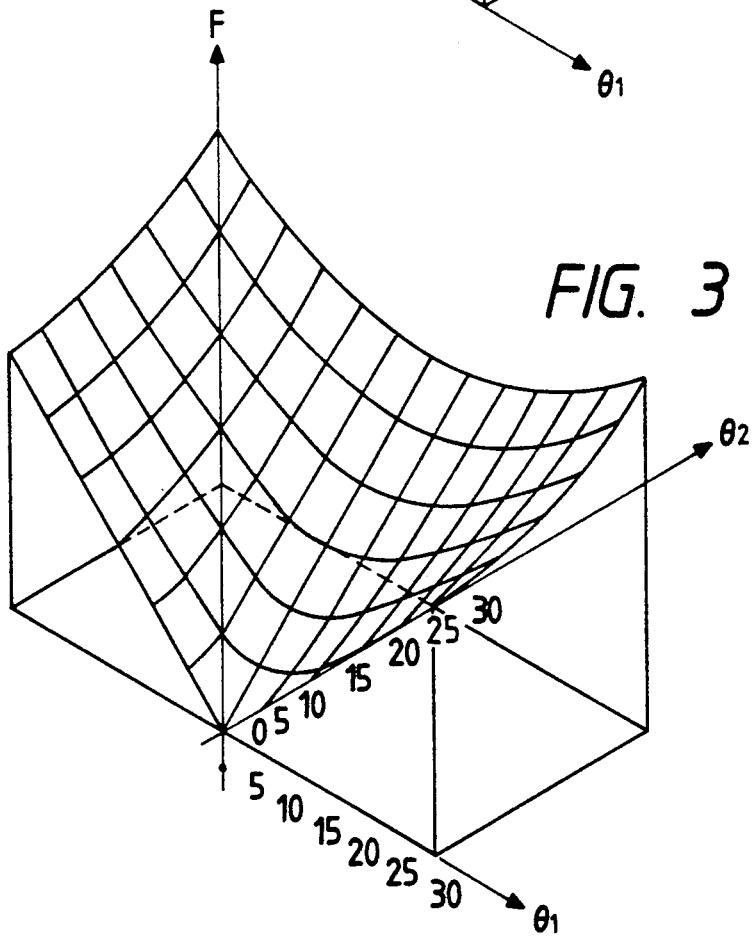
FIG. 3 is a graph showing the magnitude of a control stick holding force in a conventional joystick.

FIGS. 1(*a*) and 1(*b*) are sectional views showing a joystick according to an embodiment of the invention. FIGS. 1(*a*) and 1(*b*) show such cases that a control stick 1 is in its neutral position and that it is tilted by an angle $\theta$, respectively. FIG. 1(*c*) is a perspective view of the joystick of FIG. 1(*a*). FIG. 2 shows the relationship between a control stick holding force F and a tilt of the control stick 1.

Referring to FIGS. 1(*a*)–1(*c*), the joystick includes the control stick 1, center shafts 2*a* and 2*b*, a coil spring 3, moving member 4, spherical member 5, outer case 6, guide case 7, encoders 8*a* and 8*b*, shaft cover 9, pin 10 for rotatably connecting the control stick 1 to the center shaft 2*b*, holes 11*a* and 11*b* provided in the middle portions of the respective center shafts 2*a* and 2*b*, in which the stick 1 is loosely confined such that it can move in the longitudinal directions (axis directions) of the holes 11*a* and 11*b*. Reference numeral 12 denotes the inside surface of the guide case 7.

The center shafts 2*a* and 2*b* are orthogonally supported by the outer case 6 such that they can be swung about their respective axes. One end of each of the center shafts 2*a* and 2*b* serves as a rotary axis of the corresponding one of the encoders 8*a* and 8*b*. The center shafts 2*a* and 2*b* are rotated in accordance with the tilt direction and angle of the control stick 1.

The moving member 4 is fitted to the control stick 1, which is connected to the center shaft 2*b* with the pin 10, in its lower portion coaxially through the coil spring 3. Urged by the coil spring 3, the spherical member 5 provided at the end of the moving member 4 is made in pressure contact with the inside surface 12 of the guide case 7 secured to the outer case 6. When the control stick 1 is not manipulated, the control stick 1 is kept in the neutral position as shown in FIG. 1(*a*), where the coil spring 3 is most elongated as represented by the distance d. When the control stick 1 is manipulated, i.e., tilted, the spherical member 5 slides on the inside .surface, 12 and the coil spring 3 is compressed accordingly, to a shorter length d as shown in FIG. 1(*b*). Therefore, if the control stick 1 is released from a hand of a manipulator, the stick 1 is automatically returned to its neutral position.

According to the present invention, the inside cup surface 12 is shaped so that the coil spring 3 is compressed by $A\sqrt{\theta}$(A: constant) when the control stick 1 is manipulated so as to produce a tilt angle $\theta$ as shown in FIG. 1(*b*). By virtue of this shape of the inside surface 12, the magnitude of the stick holding force F is made uniform over the entire inside surface 12, i.e., for any tilt direction and angle of the stick 1. This will be explained below with reference to FIG. 2, where reference symbols $\theta_1$, $\theta_2$ and F represent the tilt angles of the stick 1 in the X and Y directions and the stick-holding force, respectively.

A holding moment M is considered in place of the holding force F. The relationship between the holding moment M and an energy E stored in the coil spring 3 is expressed as:

$$M = \frac{dE}{d\theta}. \quad (1)$$

In order for the magnitude of the holding force F to be uniform for any tilt angle $\theta$, following equation (2) should hold:

$$\frac{dE}{d\theta} = C. \quad (2)$$

(*C* is a constant.)

If the amount of compression ($d-d^1$) of the coil spring 3 i.e., the contraction length is denoted by $\delta$ the energy E stored in the spring 3 is expressed as:

$$E = \frac{1}{2} K\delta(\theta)^2. \quad (3)$$

(*K* is a spring modulus.)

Equation (4) is obtained from equations (2) and (3):

$$\delta(\theta) = A\sqrt{\theta}. \text{ (A is a constant.)} \quad (4)$$

Therefore, it is understood that in order to obtain the uniform magnitude of the holding force F over the entire inside surface 12 of the guide case 7, the coil spring 3 should be compressed so as to meet equation (4).

According to the invention, since the magnitude of the holding force F is thus made uniform for any tilt direction and angle of the control stick 1, the joystick can be provided with excellent manipulation ease and the control stick 1 can be returned to its central position with high accuracy.

The present invention is not confined to the embodiment described above, but may be embodied or practiced in other various ways without departing from the spirit or essential character of the invention. For example, variable resistors may be provided instead of the encoders 8*a* and 8*b*, the moving member 4 and the spherical member 5 may be integrated with each other to constitute a moving member having a spherical lower end, and/or the outer case 6 and the guide case 7 may be integrated with each other.

What is claimed is:

1. A joystick comprising:

a control stick supported in an outer case such that the control stick can be swung in two orthogonal directions;

a coil spring;

a moving member coaxially fitted to a lower portion of the control stick through the coil spring; and a guide member having a rotation-symmetrical cup-shaped inside surface to which a lower end of the moving member is urged by the coil spring so as to make pressure contact with the inside surface, the inside surface having a curvature which provides such a relationship that a contraction length of the coil spring is proportional to a square root of a tilt angle of the control stick from its neutral position.

2. A joystick according to claim 1, wherein the moving member includes a rotary spherical member at the lower end.

3. A joystick, comprising:

a frame;

a control stick pivotally supported by the frame;

a guide member having a guide surface spaced from the control stick; and a spring having at least a portion positioned between the control stick and the guide member guide surface;

wherein the guide surface is shaped so as to cause the spring to contract a distance which is proportional to the square root of the pivot angle of the control stick as the control stick is pivoted.

4. A joystick, comprising:

a frame;

a control stick pivotally supported by the frame and having a central position;

a guide member having a non-circular guide surface spaced from the control stick; and spring means coupled to the control stick for resiliently engaging the guide member surface so as to exert a holding force on the control stick as the control stick is pivoted, said holding force being directed to return the control stick to the central control position;

position the non-circular guide surface is shaped so that the holding force exerted by the spring means is substantially independent of the pivot angle of the control stick as the control stick is pivoted.

5. A joystick, comprising:

a control stick;

a frame pivotally supporting the control stick so as to allow pivotal motion of the control stick in at least two orthogonal directions;

a guide member having a rotationally symmetric and cup-shaped guide surface spaced from the control stick;

a spring coupled at one end to the control stick; and an engagement member coupled to the other end of the spring and engaging the guide member guide surface;

wherein the guide surface is shaped so as to engage the engagement member and cause the spring to contract a distance which is proportional to the square root of the pivot angle of the control stick as the control stick is pivoted.

* * * * *